US006035170A

United States Patent [19]

Snelling

[11] Patent Number: 6,035,170

[45] Date of Patent: Mar. 7, 2000

[54] REPRODUCTION MACHINE INCLUDING AN ELECTROSTATIC SONIC TONER RELEASE DEVELOPMENT APPARATUS

[75] Inventor: Christopher Snelling, E. Rochester, N.Y.

[73] Assignee: Xerox Corporation, Stamford, Conn.

[21] Appl. No.: 09/209,498

[22] Filed: Dec. 11, 1998

[51] Int. Cl.[7] ..... G03G 15/08

[52] U.S. Cl. ..... 399/266; 399/261; 399/290

[58] Field of Search ..... 399/266, 290, 399/261, 291

[56] References Cited

U.S. PATENT DOCUMENTS

| | | | |
|---|---|---|---|
| 4,546,722 | 10/1985 | Toda et al. | 118/657 |
| 4,568,955 | 2/1986 | Hosoya et al. | 346/153.1 |
| 4,647,179 | 3/1987 | Schmidlin | 355/3 DD |
| 4,833,503 | 5/1989 | Snelling | 355/259 |
| 4,868,600 | 9/1989 | Hays et al. | 355/259 |
| 4,987,456 | 1/1991 | Snelling et al. | 355/273 |
| 5,010,367 | 4/1991 | Hays | 355/247 |
| 5,255,059 | 10/1993 | Kai et al. | 355/261 |
| 5,305,070 | 4/1994 | Snelling . | |
| 5,339,142 | 8/1994 | Hays | 355/259 |
| 5,467,183 | 11/1995 | Snelling . | |
| 5,523,827 | 6/1996 | Snelling et al. | 355/259 |
| 5,742,886 | 4/1998 | Snelling et al. | 399/296 |
| 5,809,385 | 9/1998 | Snelling et al. | 399/266 |

*Primary Examiner*—Richard Moses
*Attorney, Agent, or Firm*—Tallam I. Nguti

[57] ABSTRACT

An electrostatic sonic toner release (electrostatic STORE) development apparatus, and a multicolor image reproduction machine including such a development apparatus are provided for creating toner images with reduced development fields. The electrostatic sonic toner release (electrostatic STORE) development apparatus includes a development housing defining a sump for holding developer material containing the toner particles; developer moving assembly mounted within the sump for transporting developer material within the sump; and a donor assembly mounted partially within the sump for receiving toner particles from the developer moving assembly, and for transporting the toner particles through a development nip of the reproduction machine. The donor assembly includes an acoustically deformable loudspeaker-like assembly having first and second electrode members; a dielectric member separating the first and second electrode members, means for creating air pockets against at least one of the first and second electrode members, and a polarizing voltage coupled to the first and second electrode members for generating electrostatic forces to cause acoustic motions in the acoustically deformable loudspeaker-like assembly, thereby resulting in toner release from the donor assembly, reduced image degrading electrostatic fields, and relatively higher quality image development.

11 Claims, 5 Drawing Sheets

REPRODUCTION MACHINE INCLUDING AN ELECTROSTATIC SONIC TONER RELEASE DEVELOPMENT APPARATUS

BACKGROUND OF THE INVENTION

The present invention relates to electrostatographic reproduction machines, and more particularly to such a machine including an electrostatic sonic toner release (electrostatic STORE) development apparatus having a loudspeaker-like, acoustically deformable toner donor member which greatly expands choice of donor member design materials, and advantageously reduces required image development fields.

The present invention can be utilized in the art of xerography or in the printing arts. In the practice of conventional xerography, it is the general procedure to form electrostatic latent images on an image bearing surface of a uniformly charged photoreceptor. The charge on the surface is selectively dissipated in accordance with an image-wise pattern of activating radiation corresponding to original images. The selective dissipation of the charge leaves a latent pattern of charged and discharged or charge dissipated areas on the imaging surface. In what is referred to as a Charged Area Development (CAD) environment, the discharged or charge dissipated areas on the photoreceptor correspond to residual or background voltage levels, and the still charged areas correspond to image areas. In what is referred to as a Discharged Area Development (DAD) environment, the discharged or charge dissipated areas on the photoreceptor correspond too residual or background voltage levels, and the discharged areas correspond to image areas.

In either environment, the image areas are then developed or rendered visible with charged toner particles. The charged toner particles generally comprise a colored powder whose particles adhere to the charge pattern on the image bearing surface, thus forming a toner developed image. The toner developed image is then first transferred to a receiving substrate, such as plain paper, to which it is then heated and fixed by any suitable fusing technique.

Conventional xerographic imaging techniques which were initially limited to monochrome image formation have been extended to the creation of color images, including process as well as highlight multicolor images. In either case, particularly in single pass multicolor image process machines and highlight color machines, toner developed images from an upstream development unit of the machine must be moved through the development fields of a downstream development unit. Scavenging or undesirable removal of some of the toner particles from the previously developed image, usually resulting in a less than desired quality final image, is ordinarily a problem in such multicolor machines.

Non-interactive development techniques and apparatus have been proposed for use in such multicolor image machines in order to reduce such scavenging, as well as, interaction between the previously developed image and the downstream development fields, in order to improve the developed image quality. Such donor-development or non-interactive development techniques include conventional prior art development electrode types, for example, the exposed development electrode wire technique, and the embedded development electrode techniques, examples of which will be described below. Such non-interactive development techniques also include conventional vibratory or electrostatic techniques, for example, that using sonic toner release, that using a piezo-active donor roll, and that using an electrostatic transducer, examples of which will also be described below.

Following then is a discussion of examples of such prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,523,827 entitled Piezo Active Donor Roll (PAR) For Store Development, issued Jun. 4, 1996, to Snelling et al., discloses a vibratory type development system which uses a donor roll structure including a piezoelectric layer for liberating toner particles from its surface. The donor roll is provided with a plurality of electrodes spaced about the circumference of the roll. An AC voltage is applied to the electrodes as they pass through a developer nip or zone intermediate the donor roll and an imaging member containing latent electrostatic images. The voltage is applied to each electrode and another continuous electrode which together sandwich the piezoelectric layer therebetween such that an AC voltage is applied across a portion of the piezoelectric layer in the nip thereby causing electrostatic excitation of the portion of the layer only in the nip.

U.S. Pat. No. 5,339,142 entitled AC/DC Spatially Programmable Donor Roll For Xerographic Development and issued Aug. 16, 1994, to Hays, discloses a development electrode type non-interactive development system for use in color imaging. To control the developability of lines and the degree of interaction between the toner and receiver, an AC voltage is applied between a donor roll and electrodes supported adjacent to the surface of the donor roll to enable efficient detachment of toner from the donor to form a toner cloud. An AC voltage applied between the donor roll assembly and an image receiver serves to position the cloud in close proximity to the image receiver for optimum development of lines and solid areas without scavenging a previously toned image.

U.S. Pat. No. 4,546,722 granted on Oct. 15, 1985, to Toda et al discloses a vibratory or electrostatic type development apparatus having a toner carrying member and a piezoelectric vibrator for displacing toner from the toner carrying member and causing it to fly in a manner to avoid depositing toner onto a non-image area of an image bearing surface. Such an arrangement prevents degradation of the charged image for the purpose of image preservation. Toner release control and adverse, image degradation influences are still likely, given the magnitude of the electrostatic fields.

U.S. Pat. No. 4,987,456 granted to Snelling et al., on Jan. 22, 1991, is directed to a conventional vibratory or electrostatic type apparatus in which a resonator suitable for generating vibratory energy is arranged in line contact with the back side of a charge retentive member bearing an image on a surface thereof, in an electrophotographic device, to uniformly apply vibratory energy to the charge retentive member. The resonator comprises a vacuum producing element, a vibrating member, and a seal arrangement. Where the vibratory energy is to be applied to the charge retentive surface, a vacuum is applied by the vacuum producing element to draw the surface into intimate engagement with the vibrating member, and edge seal arrangement. The invention has application to a transfer station for enhancing electrostatic transfer of toner from the charge retentive surface to a copy sheet, and to a cleaning station, where mechanical vibration of the surface will improve the release of residual toner remaining after transfer.

U.S. Pat. No. 5,255,059 granted on Oct. 19, 1993, to Kai et al., discloses a vibratory or electrostatic type image forming apparatus incorporating a stationary, hollow cylindrical donor structure including a single set of electrodes within its hollow, and a piezoelectric layer formed over the electrodes. The donor structure may be in the form of a roll or a belt. In each embodiment disclosed, a phase shifted voltage is applied to the electrodes for the purpose of creating a waving action which is effective to transport toner particles from a sump to a development zone. Thus, while the toner is moved through electrostatic action alone of the waving materials, the donor structure itself is stationary.

U.S. Pat. No. 4,568,955 issued on Feb. 4, 1986, to Hosoya et al., discloses a development electrode type recording apparatus wherein a visible image based on image information is formed on an ordinary sheet by a developer. The recording apparatus comprises a donor roller spaced at a predetermined distance from and facing the ordinary sheet and carrying the developer thereon, a recording electrode and a signal source connected thereto for propelling the developer on the developing roller to the ordinary sheet by generating an electric field between the ordinary sheet and the developing roller according to the image information, and a plurality of mutually insulated electrodes provided on the developing roller and extending therefrom in one direction. An AC and a DC source are connected to the electrodes, for generating an alternating electric field between adjacent ones of the electrodes to alone cause oscillations of the developer found between the adjacent electrodes along electric lines of force therebetween to thereby liberate the developer from the developing roller, and to thereby form the toner particles into smoke in the vicinity of the donor roller and the sheet.

U.S. Pat. No. 5,010,367 granted to Hays on Apr. 23, 1991, relates to a development electrode type non-interactive development system for use in color imaging. To control the developability of lines and the degree of interaction between the toner and receiver, an AC voltage alone is applied between a donor roll and electrodes supported adjacent to the surface of the donor roll to enable detachment of toner from the donor to form a toner cloud. An AC voltage applied between the donor roll assembly and an image receiver serves to position the cloud in close proximity to the image receiver for optimum development of lines and solid areas without scavenging a previously toned image.

U.S. Pat. No. 4,833,503 granted to Snelling on May 23, 1989, is directed to a multi-color printer using a conventional vibratory or electrostatic type apparatus. In it, vibratory energy only is provided by a sonic toner release development system in an attempt to develop either partial or full color images with minimal degradation by subsequent over-development.

U.S. Pat. No. 4,647,179 issued Mar. 3, 1987, to Schmidlin, discloses a development electrode type development apparatus including only a traveling electrostatic AC wave conveyor for transporting toner particles from a development housing to an imaging surface. The traveling electrostatic AC wave conveyor comprises a linear array of spaced apart conductive electrodes and a phase shifted multiphase AC voltage source connected to the electrodes for creating the wave.

U.S. Pat. No. 4,868,600 issued Sep. 19, 1989, to Wayman et al., discloses a development electrode type development apparatus in which AC electric fields alone are applied to self-spaced electrodes positioned within a development nip. The electrodes are mounted at their ends to bearing blocks, and are self-spaced from the donor member by toner particles.

Non-interactive development as practiced for example in a development electrode type development apparatus, typically depends only upon electrostatic fringe fields to disturb charged toner particles residing on a donor surface for the purpose of development of a latent electrostatic image in a non-interactive manner. In fact, in the type of development units having exposed electrode wires within the development nip, relatively high level AC fields are typically required, in part, for generating an avalanche like effect in order to release additional toner particles from the donor. As such, the electrostatic fringe fields must be at a level that is relatively high enough to overcome attractive forces between the toner particles and the donor member.

Unfortunately, such a relatively high fringe field undesirably will interact with a toner image being moved through it. This usually dictates that the process will be scavenging. Additionally using these relatively high fringe fields can sometimes lead to micro-arcing or corona discharge between the development electrodes and the donor member, leading either directly to non-uniform image defects, or to undesirable non-uniform coating of the electrodes.

Additionally, conventional development electrode type development units which have exposed electrode wires within the development nip often suffer from undesirable toner particle agglomeration on the electrode wires. Such agglomeration usually results in image defects such as development streaks, in final images.

On the other hand, non-interactive vibratory or electrostatic type development units, (as disclosed in any of the relevant example references above), typically each utilizes vibratory energy alone to effect toner particle release from the development nip side of the donor member by mechanically reducing toner particle adhesion forces on the donor member. The vibratory energy alone therefore must be of a level high enough to effect such toner release, and additionally enable toner particle travel for image development across an air gap in the development nip within a D. C. electrostatic field. A lack of uniformity of vibratory motion in the development nip necessary over the full length of the donor roll to accelerate the toner particles to release from the donor member is an issue for these devices. Alternatively, if designed to vibrate over the full circumference such required levels of vibratory energy for toner release on the development nip side of the donor member tend to simultaneously and detrimentally affect developer material loading to the donor member on the opposite side thereof, thus placing mechanical strains and toner control conflicts on this type of development unit.

SUMMARY OF THE INVENTION

In accordance with the present invention, there is provided an electrostatic sonic toner release (electrostatic STORE) development apparatus, and a multicolor image reproduction machine including such a development apparatus are provided for creating toner images with reduced development fields. The electrostatic sonic toner release (electrostatic STORE) development apparatus includes a development housing defining a sump for holding developer material containing the toner particles; developer moving assembly mounted within the sump for transporting developer material within the sump; and a donor assembly mounted partially within the sump for receiving toner particles from the developer moving assembly, and for transporting the toner particles through a development nip of the reproduction machine. The donor assembly includes an acoustically deformable loudspeaker-like assembly having first and second electrode members; a dielectric member separating the first and second electrode members, means for creating air pockets against at least one of the first and second electrode members, and a polarizing voltage coupled to the first and second electrode members for generating electrostatic forces to cause acoustic motions in the acoustically deformable loudspeaker-like assembly, thereby resulting in toner release from the donor assembly, reduced image degrading electrostatic fields, and relatively higher quality image development.

In accordance with another aspect of the present invention, there is provided an electrostatographic reproduction machine for creating toner images with reduced development fields. The reproduction machine includes a movable image bearing member supported for movement in an endless path; means for forming latent electrostatic images on said image bearing member; and an electrostatic sonic toner release (electrostatic STORE) development apparatus. The electrostatic sonic toner release (electrostatic STORE) development apparatus includes a development housing defining a sump for holding developer material containing the toner particles; developer moving assembly mounted within the sump for transporting developer material within the sump; and a donor assembly mounted partially within the sump for receiving toner particles from the developer moving assembly, and for transporting the toner particles through a development nip of the reproduction machine. The donor assembly includes an acoustically deformable loudspeaker-like assembly having first and second electrode members; a dielectric member separating the first and second electrode members, means for creating air pockets against at least one of the first and second electrode members, and a polarizing voltage coupled to the first and second electrode members for generating electrostatic forces to cause acoustic motions in the acoustically deformable loudspeaker-like assembly, thereby resulting in toner release from the donor assembly, reduced image degrading electrostatic fields, and relatively higher quality image development.

DESCRIPTION OF THE DRAWINGS

In the detailed description of the invention presented below, reference will be made to the drawings, in which.

DETAILED DESCRIPTION OF THE INVENTION

This invention relates to an imaging or reproduction system which is used to produce a multi-color output image. It will be understood that it is not intended to limit the invention to the embodiment disclosed. On the contrary, it is intended to cover all alternatives, modifications and equivalents as may be included within the spirit and scope of the invention as defined by the appended claims.

Figure 1:
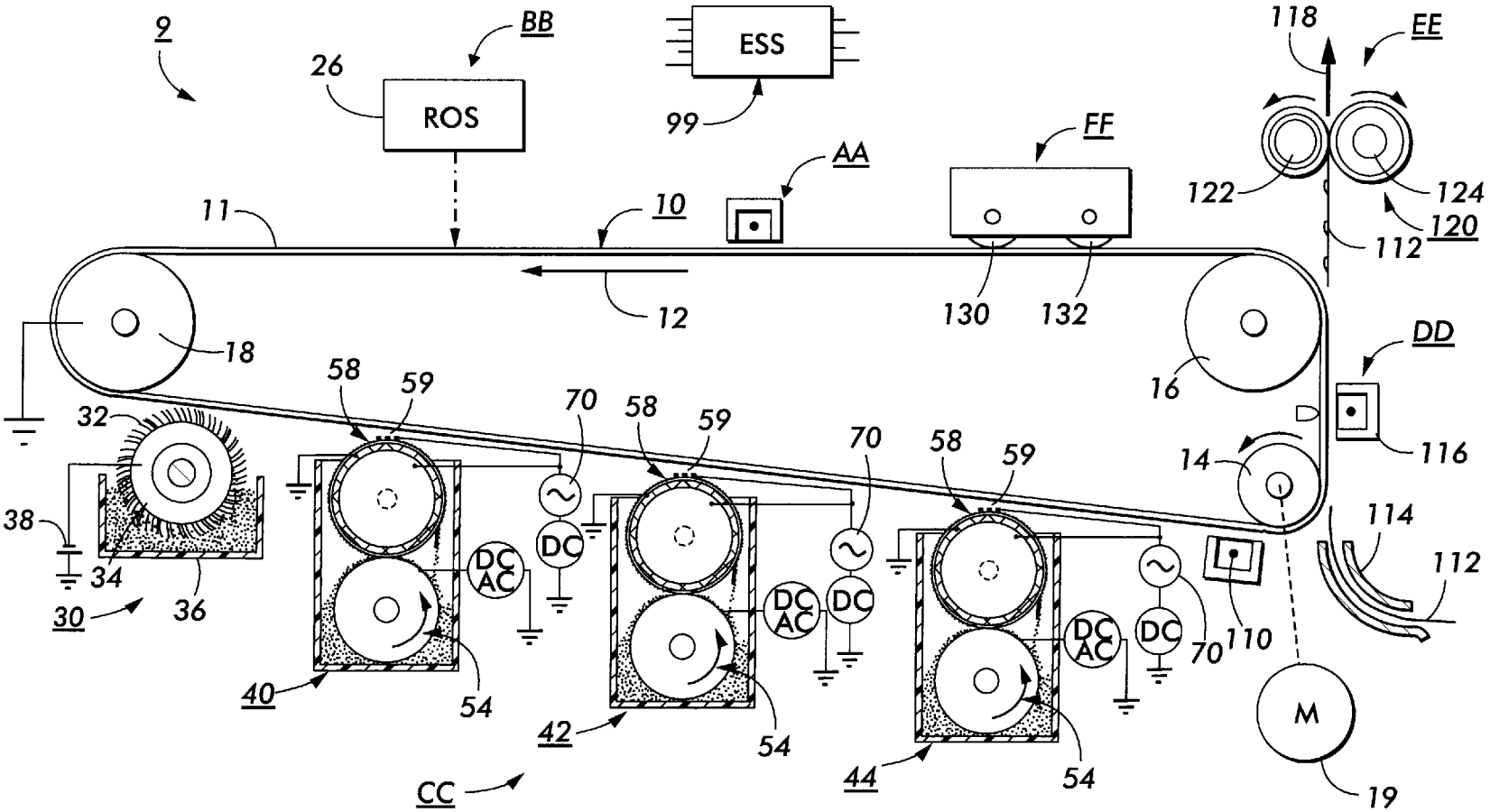
FIG. 1 is a schematic illustration of a multicolor image reproduction machine including an electrostatic sonic toner release (electrostatic STORE) development apparatus in accordance with the present invention.

FIG. 1 schematically depicts the various components of an illustrative electrophotographic reproduction machine 9 that incorporates the electrostatic sonic toner release (electrostatic STORE) development apparatus of the present invention. As shown in FIG. 1, the electrostatographic reproduction machine 9, includes a monopolar photoreceptor belt 10 having a photoconductive surface 11 that is formed on conductive substrate. Belt 10 moves in the direction indicated by arrow 12, advancing sequentially through various types of xerographic process stations, as are well known. The belt is entrained about a drive roller 14 and two tension rollers 16 and 18. The roller 14 is operatively connected to a drive motor 19 for effecting movement of the photoreceptor belt 10 in an endless path.

With continued reference to FIG. 1, a portion of belt 10 passes through charging station AA where a corona generating device, indicated generally by the reference numeral 22, charges the photoconductive surface 11 of belt 10 to a relative high, and substantially uniform, negative potential, for example.

Next, the uniformly charged portions of the surface 11 are advanced through exposure station BB. At exposure station BB, the uniformly charged photoreceptor or charge retentive surface 11 is exposed to a laser is Raster Output Scanner (ROS) device 26 which causes the charge retentive surface 11 to be discharged in some areas in accordance with the output from the scanning device. Although the ROS device could be replaced by a conventional xerographic exposure device, preferably the ROS device 26 is a three level device suitable for performing tri-level latent imaging.

Tri-level latent imaging for highlight color xerography is described, for example, in U.S. Pat. No. 4,078,929 issued in the name of Gundlach, (and incorporated herein by reference). Tri-level xerography is used typically as a means for achieving single-pass highlight color imaging. In highlight color imaging achieved thus, xerographic contrast on the charge retentive surface 11 of the photoreceptor is divided into three levels, rather than into two levels, as is the case in conventional xerography.

In tri-level imaging, the charge retentive surface 11 of the photoreceptor is initially charged to a voltage $V_0$, which is typically larger in magnitude than −900 volts, but which after undergoing some dark decay, is reduced to a stable photoreceptor voltage $V_{ddp}$ of about −900 volts. The surface 11 is then exposed image-wise such that one image, corresponding to charged image areas (which are subsequently developed using charged-area development, (CAD) techniques, stays at the full photoreceptor potential of $V_{CAD}$ equal to $V_{ddp}$).

To form the other or second image, the surface 11 is also exposed so as to discharge the photoreceptor to a residual potential, $V_{DAD}$ equal to $V_c$ which is typically about −100 volts. The other or second image thus corresponds to areas discharged to the residual potential, and which are subsequently developed using discharged-area development (DAD) techniques. To form the background areas (the third level), the surface 11 is next also exposed so as to reduce the photoreceptor potential in such background areas to a level $V_{white}$ or $V_w$ (typically −500 volts), which is is halfway between the $V_{CAD}$ and $V_{DAD}$ potentials. Following such tri-level latent image formation, the surface 11 is advanced to the development station CC.

At development station CC, a plurality of development units are provided, and include a magnetic brush development unit, and several units of the non-interactive (electrostatic STORE) development apparatus of the present invention (several embodiments of which will be described in detail below). For developing the first latent CAD image at $V_{CAD}$, at the development station CC, a magnetic brush development unit, indicated generally by the reference numeral 30, is provided for advancing developer material 34 into contact with the CAD electrostatic latent images on the surface 11. As shown, the development unit 30 comprises at least a magnetic brush 32, and a supply of two-component developer material 34 contained in a developer housing 36. The two-component developer material 34 comprises a mixture of carrier beads and black toner particles, along with additives as needed for specific applications.

For the negatively charged, CAD image development, the black toner particles are positively charged. As shown, a suitable negative developer bias is applied to the developer unit 30 from a DC power source 38. The CAD development unit 30 is typically biased about 100 volts closer to $V_{CAD}$ than $V_{white}$ (therefore at about −600 volts).

Magnetic brush development as provided by the unit 30 is an interactive unit, with the developer unit directly interacting with the image being developed. However, it is suitable for developing the CAD images because it is the first development unit in a multiple development unit, single pass process machine. As such, toner developed images do not have to be moved through and past its development fields, and hence there is no risk of scavenging and image degradation from its fields. There are however such risks with respect to the other multiple development units mounted downstream of the unit 30 in such a machine, particularly as here, for developing the discharged area development, or DAD, images.

Accordingly, the discharged area development or DAD images, are preferably developed using the non-interactive (electrostatic STORE) development units of the present invention, shown generally as 40, 42 and 44 (to be described in detail below). The development units 40, 42, and 44 are each biased about −100 volts closer to $V_{DAD}$ than $V_{white}$ (therefore at about −400 volts).

Still referring to FIG. 1, a color controller (ESS) 99 and user interface (not shown) provide means for user selection of the final color for the DAD image. The user interface, for example, may comprise a plurality of control knobs, one for each non-interactive development unit. By reference to a color palette, not shown, the user can obtain the settings for the control knobs. For example, once a specific color is identified by the user the setting of these knobs determines the individual biases for the development units. In addition, since the photoreceptor contains both positive and negative toner particles thereon, a pre-transfer corotron 110 is provided for effecting a unipolar image prior to transfer at a transfer station DD.

After the electrostatic latent image has been subjected to the pre-transfer corotron 110, the photoreceptor belt advances the toner powder images to transfer station DD. A copy sheet 112 is advanced to transfer station DD by sheet feeding apparatus, not shown. Preferably, the sheet feeding apparatus includes a feed roll contacting the uppermost sheet of a stack of sheets. The feed roll rotates to advance the uppermost sheet from stack into chute 114. Chute 114 directs the advancing sheet into contact with photoconductive surface 11 of belt 10 in a timed sequence so that the toner powder images developed thereon contact the advancing sheet at transfer station DD. Transfer station DD includes a corona generating device 116 which sprays ions onto the back side of sheet 112. This attracts the toner powder image from photoconductive surface 11 to sheet 112. After transfer, sheet 112 continues to move in the direction of arrow 118 onto a conveyor (not shown) which advances sheet 112 to fusing station EE.

Fusing station EE includes a fuser assembly, indicated generally by the reference numeral 120, which permanently affixes the transferred powder image to sheet 112. Fuser assembly 120 includes a heated fuser roller 122 and back-up roller 124. Sheet 112 passes between fuser roller 122 and back-up roller 124 with the toner powder image contacting fuser roller 122. In this manner, the toner powder image is directly heated and permanently affixed to sheet 112. After fusing, sheet 112 advances through a chute, not shown, to a catch tray, also not shown, for subsequent removal from the reproduction machine by the operator.

After the copy sheet is separated from photoconductive surface 11 of belt 10, the residual toner particles adhering to photoconductive surface 11 are removed therefrom at cleaning station FF. Cleaning station FF may include a rotatably mounted fibrous brushes 130, 132 in contact with photoconductive surface 11. Subsequent to cleaning, a discharge lamp (not shown) floods the photoreceptor with light to dissipate any residual electrostatic charge remaining thereon prior to the charging thereof for the next successive imaging cycle.

Referring now to FIGS. 1–6, each of the electrostatic sonic toner release (electrostatic STORE) development units 40, 42 and 44 as used in the machine 9 is identical to the others in this group, except for the particular color of toner particles each contains. Additionally, the set of units 40, 42, and 44 can be of either of the embodiments of FIGS. 3–6. In accordance with the present invention, each of the units 40, 42 and 44 contains and is adapted to selectively deposit varying amounts of appropriately charged, color (other than black) toner particles, onto the DAD portion of the tri-level image in a highlight color machine as shown, or onto appropriate color separation images in a full process color machine. For example, these non-interactive development units 40, 42, 44 may contain and selectively deposit negatively charged, magenta, yellow and cyan toners, respectively, on the DAD images.

In each of the embodiments disclosed below, the representative (electrostatic STORE) development apparatus 50, 72, 82 of the development apparatus (40, 42, 44) of the present invention, each advantageously includes a donor roll member having a loudspeaker-like acoustically deformable member 200 for producing electrostatic forces that are used to generate acoustic motions or deformations required for toner release control and reduced image degrading electrostatic fields, thereby resulting in relatively higher quality image development. The use of a donor roll member 58 having the loudspeaker-like acoustically deformable member 200 thus eliminates a need for relatively expensive materials that produce piezoelectric effect based motions. Use of electrostatic forces as such also greatly expands the number of materials and design options available for toner release control and reduced image degrading electrostatic fields.

Figure 2:
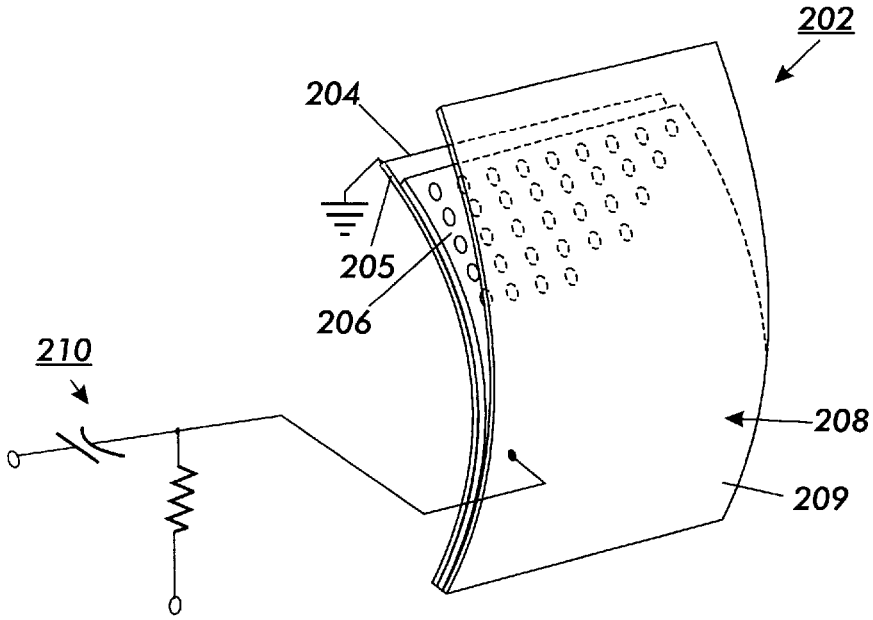
FIG. 2 PRIOR ART
FIG. 2 is an illustration of a first version of an electrostatic loudspeaker serving generally as background information to the present invention.
Figure 3:
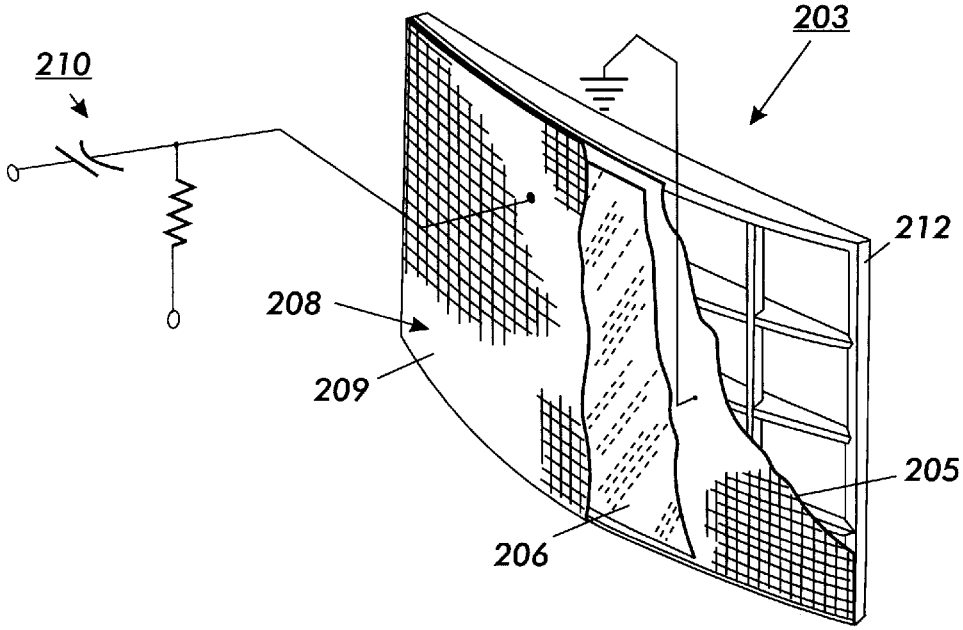
FIG. 3 PRIOR ART
FIG. 3 is an illustration of a second version of an electrostatic loudspeaker serving generally as background information to the present invention.

Referring in particular to FIGS. 2 and 3, first and second versions of electrostatic loudspeakers are illustrated as informational background. As disclosed for example on pages 441–442 of "HANDBOOK FOR SOUND ENGINEERS THE NEW AUDIO CYCLOPEDIA" (Glen Ballou, Editor, and Hoeard Sams & Co. publishers), an electrostatic loudspeaker is an acoustic transducer consisting at least of two pieces of metallic foil (first and second electrodes) separated by a sheet of dielectric. A polarizing voltage applied to the foils maintains a steady attraction between them. Audio-frequency voltages are superimposed on the polarizing voltage, and may either add to or subtract from the polarizing voltage, thus causing the foils to move in accordance with the waveforms of the applied audio-frequency voltage. The movement of the foils generate sound waves. Electrostatic loudspeakers as such, operate as push-pull transducers because they are essentially linear in operation and free from waveform distortions, and produce neither even nor odd harmonics.

In the FIG. 2 version, the electrostatic loudspeaker 202 comprises a back plate or support member 204 which can be conductive thus acting as a first electrode 205, a dielectric diaphragm 206 stretched over the first electrode 205, and a conductive foil 208, acting as a second electrode 209, stretched over the diaphragm. This leaves an air pocket between the diaphragm 206 and the two electrodes 205, 209. The polarizing voltage 210 as shown is applied across the two electrodes 205,209. In the second version of FIG. 3, the electrostatic loudspeaker 203 comprises a separate, nonconductive support frame 212; first and second electrodes 205, 209; an inert diaphragm 206 that is supported by a large multiplicity of tiny conductive elements that are disposed across the entire surfaces of the two electrodes 205, 209; and a polarizing voltage 210 applied across the two electrodes. The multiplicity of tiny elements act as spacers to hold the diaphragm 206 in the center between the electrodes. Principles of electrostatic loudspeaker-like, acoustic vibrations or motions from these versions have been advantageously adapted in accordance with the present invention, as will be described in detail below.

Figure 4:
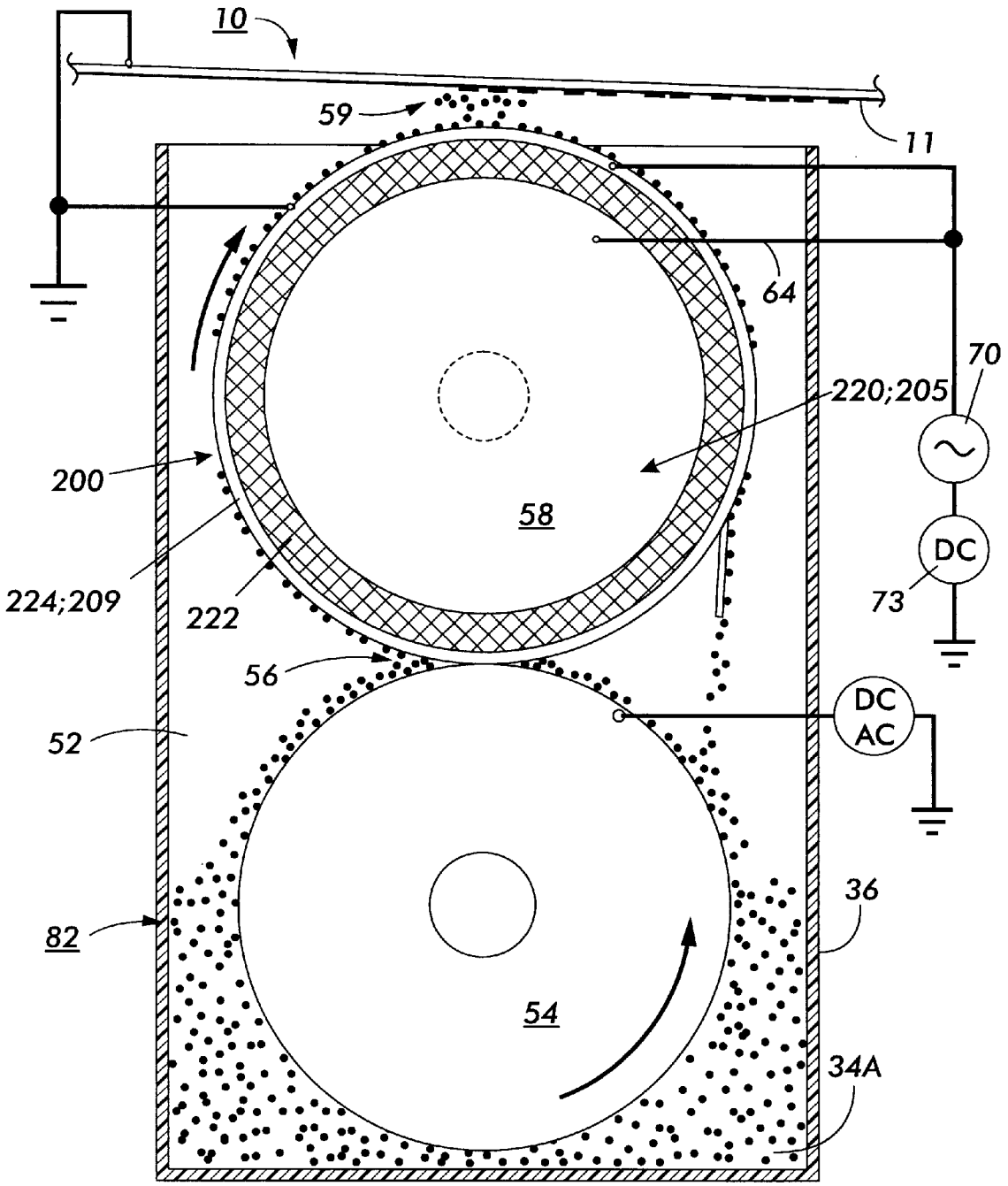
FIG. 4 is an enlarged schematic illustration of the (electrostatic STORE) development apparatus of FIG. 1 including an insulative screen.

Referring now to FIG. 4, a first embodiment of the (electrostatic STORE) non-interactive development unit (40, 42, 44) of the present invention is illustrated generally as 50. The representative apparatus 50 includes a development housing 36 defining a sump 52 containing developer material 34A as shown, or 34B, 34C of a non-black color, for example magenta, cyan, yellow. The developer material 34A, 34B, 34C is mixed and triboelectrically charged within the sump 52 by mixing augers (not shown), and picked up by a feeder magnetic roll 54. The picked up developer material serves to electrostatically load toner at a nip 56 from the magnetic roll 54 onto a donor roll assembly 58 that includes a loudspeaker-like acoustically deformable member 200 of the present invention. The assembly 58 is preferably shown in the form of a roller, but equally can be in belt form. As shown, the (electrostatic STORE) development unit 50 is mounted within a machine such that the loudspeaker-like acoustically deformable member 200 of the roller 58 forms a development nip (or air gap) 59 with the surface 11 of the latent image bearing member 10, for presenting toner particles to latent electrostatic images on the surface for image development.

More specifically, as disclosed in FIGS. 1 and 4, the donor assembly 58 of the first embodiment 50 of the electrostatic STORE development apparatus of the present invention includes a conductive support 220 forming a first electrode 205, a deformable insulative screen 222 that additionally acts as a spacing member against which air pockets are formed for required acoustic motions, and a conductive loudspeaker-like, deformable member 200 that forms a second electrode 209.

Importantly, the conductive, loudspeaker-like deformable member 200 comprises at least a conductive surface layer or film 224. The conductive acoustically deformable member 200 should be thin, mounted tautly and, for example, can be made from a thin strong aluminized polyester film such as aluminized MYLAR (Trademark of Du Pont) film. The acoustically deformable member 200 may additionally includes a bottom deformable dielectric layer (not shown) that will mount over the insulative screen 222. A polarizing A.C. voltage biasing source 70 is provided between the conductive support 220 forming the first electrode 205, and the second electrode 209 (i.e. the conductive surface layer or film 224) of the deformable member 200. The thickness of the acoustically deformable member 200, and the value of the biasing source 70, should be selected so as to produce vibrations or acoustic deformations of about 0.001" (about 25 microns). By making the applied bias source 70 an A.C. bias source, the acoustically deformable member 200 is deformed as such in response to both phases of the bias, and hence ordinarily at twice the applied frequency of such bias since the electrostatic forces of attraction are independent of polarity. Importantly in this embodiment, a second bias source 73, shown preferably as a D.C. bias, is used to prevent the actual frequency of the acoustically deformable member 200 from having a doubling effect. Application of a D.C. bias 73 in series with the A.C. bias 70 serves to suppress the frequency doubling effect but in addition, it serves to deform the conductive surface layer or film 224 toward the conductive support layer 220, as well as reduces the spacing between the surface layer 224 and such support layer. Reducing the spacing as such increases the magnitude of the acoustically modulated electrostatic forces for deforming the conductive surface layer 224.

For example, deformations of a 0.001" (25$\mu$) were obtained experimentally using a thin strong aluminized polyester film such as an aluminized MYLAR film having an insulative base layer, and a polarizing A.C. voltage of approximately 400 V peak to peak at 130 KHz to 300 KHz, thus demonstrating the electrostatic STORE development apparatus concepts in accordance with the first embodiment of FIGS. 1 and 4 of the present invention. In the experiment, toner was advantageously developed across a development nip (such as 59 FIG. 4) requiring a development field of only 1 v/$\mu$, instead of a conventional 4 V/$\mu$ development field required for development in the absence of the acoustic deformations or acoustic motions of the present invention.

Figure 5:
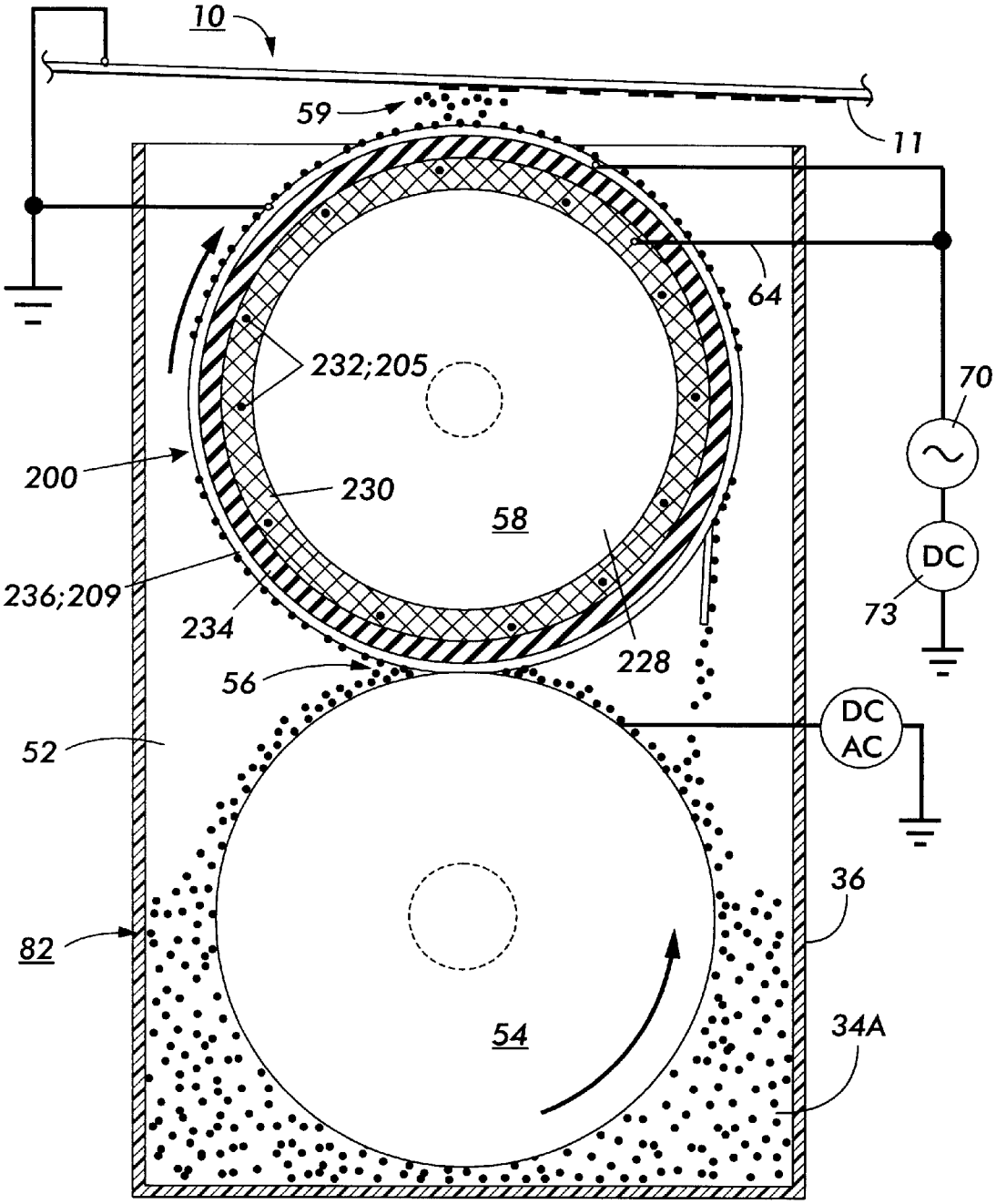
FIG. 5 is a schematic illustration of a second embodiment of the (electrostatic STORE) development apparatus of FIG. 1 including a conductive screen.

Now, referring in particular to FIG. 5, a second embodiment of the (electrostatic STORE) non-interactive development unit (40, 42, 44) of the present invention is illustrated generally as 72. Similarly, the representative apparatus 72 includes a development housing 36 defining a sump 52 containing developer material 34A as shown, or 34B, 34C of a non-black color, for example magenta, cyan, yellow. The developer material 34A, 34B, 34C is mixed and triboelectrically charged within the sump 52 by mixing augers (not shown), and picked up by a feeder magnetic roll 54. The picked up developer material serves to electrostatically load toner at a nip 56 from the magnetic roll 54 onto a donor roll assembly 58 that includes a loudspeaker like acoustically deformable member 200 of the present invention. The (electrostatic STORE) development unit 72 will be mounted within a machine such that the conductive acoustically deformable member 200 of donor member or roller 74 forms a development nip 59 with the latent image bearing member surface 11 for presenting toner particles to latent electrostatic images on the surface 11 for image development.

More specifically, as disclosed in FIG. 5, the donor assembly 58 of the second embodiment 72 of the electrostatic STORE development apparatus of the present invention includes a nonconductive support member 228, a conductive woven screen 230 including conductive wires 232 each forming a first electrode 205. Additionally the conductive woven screen 230 acts as a spacing member against which air pockets are formed for required acoustic motions. Importantly, the second embodiment 72 includes a conductive loudspeaker-like acoustically, deformable member 200 that comprises a dielectric or insulative layer 234 and a top conductive layer 236 forming a second electrode 209 in accordance with the present invention. The conductive, loudspeaker-like acoustically deformable member 200 preferably should be thin, and mounted tautly over the conductive woven screen 230. It thus can be made from a thin strong aluminized polyester film such as aluminized MYLAR (Trademark of Du Pont) film.

As shown, the second embodiment 72 also includes a polarizing A.C. voltage biasing source 70 which is provided between the conductive wires 232 (of the woven screen 230) which each form a first electrode, and the conductive surface layer or film 236 (of the acoustically deformable member 200), which forms the second electrode. The thickness of the acoustically deformable member 200, and the value of the biasing source 70, should be selected so as to produce vibrations or acoustic deformations of about 0.001" (about 25 microns).

The polarizing bias source 70 causes electrostatic forces of attraction which attempt to wrap the acoustically deformable member 200 around the wires 232 of the conductive woven screen 230. Wrapping around the wires 232 as such results in a changing of the ordinarily taut position of the acoustically deformable member 200. By making the applied bias source 70 an A.C. bias source, the acoustically deformable member 200 is deformed as such in response to both phases of the bias, and hence ordinarily at twice the applied frequency of such bias since the electrostatic forces of attraction are independent of polarity. Importantly in this embodiment, a second bias source 73, shown preferably as a D.C. bias, is used to prevent the actual frequency of the acoustically deformable member 200 from having a doubling. Application of the D.C. bias 73 in series with the A.C. bias 70 serves to suppress the frequency doubling effect but in addition, it serves to deform the conductive surface layer or film 236 toward the conductive screen 230, as well as reduces the spacing between the surface layer 236 and such conductive screen. Reducing the spacing as such increases the magnitude of the acoustically modulated electrostatic forces for deforming the conductive surface layer 236.

Figure 6:
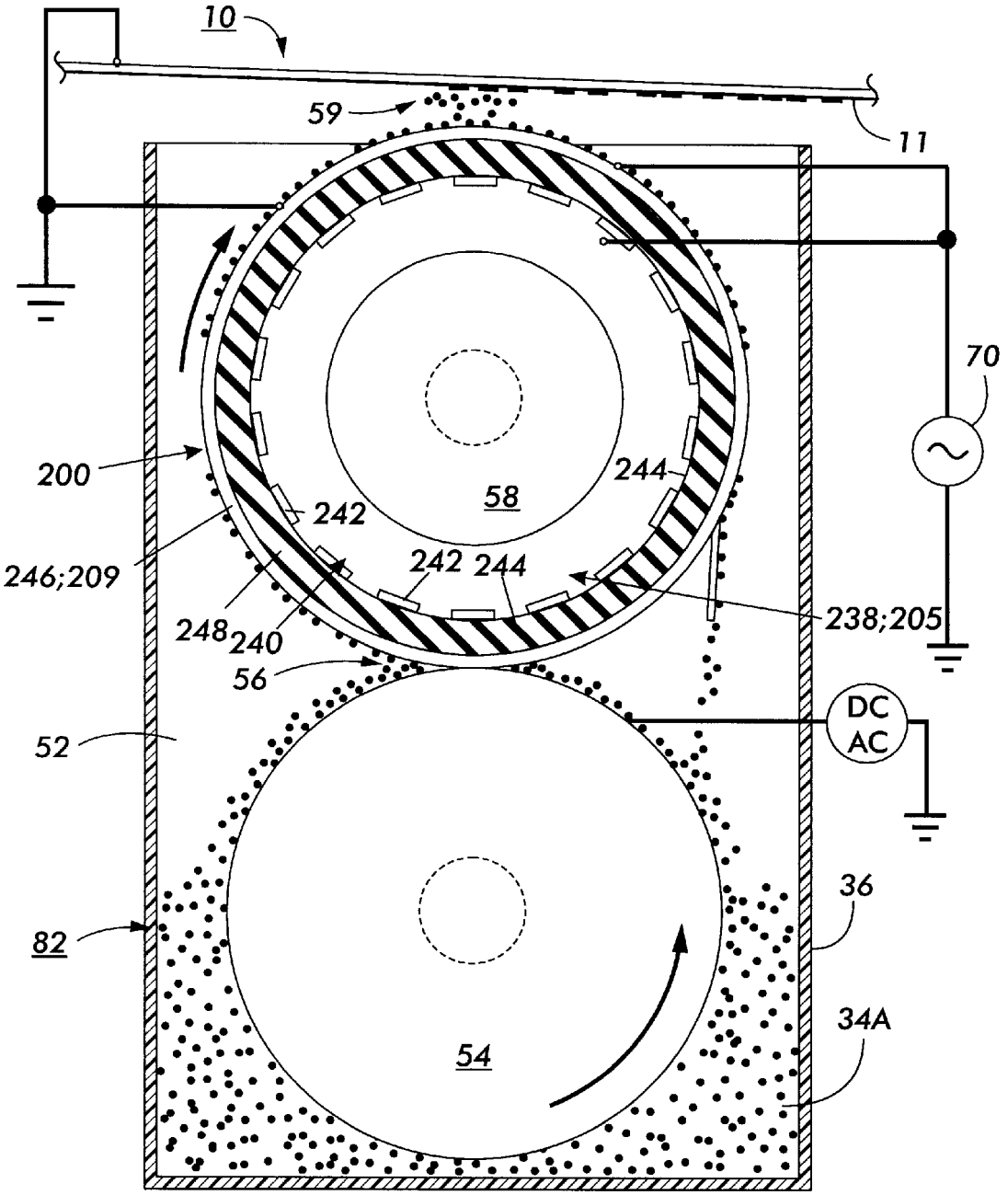
FIG. 6 is a schematic illustration of a third embodiment of the (electrostatic STORE) development apparatus of the present invention including a relief-surface drum.

Referring next and in particular to FIG. 6, a third embodiment of the (electrostatic STORE) non-interactive development unit (40, 42, 44) of the present invention is illustrated generally as 82. Similarly the embodiment 82 includes a development housing 36 defining a sump 52 containing developer material 34A as shown, or 34B, 34C of a non-black color, for example magenta, cyan, yellow. The developer material 34A, 34B, 34C is mixed and triboelectrically charged within the sump 52 by mixing augers (not shown), and picked up by a feeder magnetic roll 54. The picked up developer material serves to electrostatically load toner at a nip 56 from the magnetic roll 54 onto a donor roll assembly 58 that includes a loudspeaker-like acoustically deformable member 200 of the present invention.

As shown in detail (FIG. 6), the core 238 of the donor roll 58 is conductive, and has a relief pattern 240 of recesses 242 surrounded by ridges 244. As such, when a conductive acoustically deformable member 200 is mounted over the relief pattern 240, it cooperates with the recesses 242 and ridges 244 to create air pockets within the recesses 242 for loudspeaker like vibrations under the influence of a polarizing voltage. As shown, a polarizing A.C. voltage biasing source 70 is provided between the conductive core 238, forming the first electrode 205, and a second electrode 209 (i.e. the conductive surface layer or film 246) of the deformable member 200 For example, the conductive acoustically deformable member 200 can be a seamless, thin, strong aluminized polyester film such as an aluminized MYLAR (Trademark of Du Pont) sleeve 246, having an insulative under layer 248, that is heat shrunk onto the drum core 238 having an appropriate relief pattern, such as 240, on its surface. This would produce a pattern of electrostatic "speaker" activity cells around the entire circumference of the drum. The end result would be a rigid drum structure having a deformable surface.

In each of the various embodiments of the electrostatic STORE development apparatus of the present invention, suitable means (not shown) would be provided for commutating the voltages including the polarizing voltage to the electrodes. Brush commutation, for example, can be adapted to provide desired control for acoustic activity, particularly where isolation of the area of acoustic activation to the development nip is known to be important.

As can be seen, there has been provided a multicolor reproduction machine, and an advantageous non-interactive (electrostatic STORE) development apparatus according to the present invention. The electrostatic sonic toner release (electrostatic STORE) development apparatus comprises a single component donor development member, a periodic array of excitable electrodes located axially around a circumference of the donor development member, a taut, thin metalized layer, a dielectric layer such as a MYLAR sleeve, overlaying the periodic array of excitable electrodes, and an Ac bias source coupled to the electrodes.

The (electrostatic STORE) development apparatus produces AC electrostatic forces for generating loud speaker-like acoustic oscillations and deformations in the taut, metalized layer. The dielectric layer flexes above the periodic array of excitable electrodes (AC-biased wires), thus loosening toner particles from the surface of the donor member. Such oscillations and deformations significantly and advantageously effect a reduction in a level of forces adhering toner (toner adhesion forces) to the donor member. The reduction in toner adhesion forces, thus significantly reduces required development fields and enhances scavengeless image development. The (electrostatic STORE) development apparatus as such advantageously eliminates a need for biased wires or external electrodes (as well as complex mounting problems associated with such electrodes) in the air gap or nip between a conventional donor member and a photoreceptor bearing latent images being developed.

Specifically, the electrostatic sonic toner release (electrostatic STORE) development apparatus uses a loud speaker-like AC electrostatic field to induce acoustical vibrations in a taut, metalized surface, MYLAR (Trademark of Du Pont) sleeve overlaying a periodic array of excitable electrodes located axially around the circumference of a single component donor development roll. The oscillations and deformations of the dielectric or MYLAR sleeve provide the energy necessary to loosen and overcome toner-to-donor member adhesive forces, and thereby enable enhanced toner development of latent images at substantially relatively smaller development fields, than fields that would under similar conditions be needed for conventional xerographic development. The (electrostatic STORE) development apparatus as such advantageously also eliminates a need for piezoelectric-effect based motions for releasing toner particles, and greatly expands a number of different types of materials and design options available for implement sonic toner release development processes.

While the present invention has been described with reference to a preferred embodiment, it will be appreciated from this teaching that within the spirit of the present invention, various alternative modifications, variations or improvements therein may be made by those skilled in the art.

What is claimed is:

1. An electrostatic sonic toner release (electrostatic STORE) development apparatus for developing latent electrostatic images in a toner image reproduction machine using charged toner particles, the (electrostatic STORE) development apparatus including:

(a) a development housing defining a sump for holding developer material containing the toner particles;

(b) developer moving means mounted within said sump for transporting developer material within said sump; and (c) a donor assembly mounted partially within said sump for receiving toner particles from said developer moving means and for transporting the toner particles through a development nip of a reproduction machine, said donor assembly including an acoustically deformable loudspeaker-like assembly having first and second electrode members, a dielectric member separating said first and second electrode members, means for creating air pockets against at least one of said first and second electrode members, and a polarizing voltage coupled to said first and second electrode members for generating electrostatic forces to cause acoustic motions in said acoustically deformable assembly, thereby resulting in toner release from said donor assembly, reduced image degrading electrostatic fields, and relatively higher quality image development.

2. The electrostatic sonic toner release (electrostatic STORE) development apparatus of claim 1, wherein said acoustically deformable loudspeaker-like assembly includes a conductive support member comprising said first electrode member, a top conductive layer comprising said second electrode member, an insulative screen member separating said conductive support member from said top conductive layer and comprising means for forming air pockets against said top conductive layer, and a polarizing voltage coupled to conductive support member and said top conductive layer.

3. The electrostatic sonic toner release (electrostatic STORE) development apparatus of claim 1, wherein said acoustically deformable loudspeaker-like assembly includes a nonconductive support member, a conductive screen comprising said first electrode member as well as means for forming air pockets with a deformable member, a deformable top conductive layer comprising said second electrode member, an insulative member separating said conductive screen from said top conductive layer, and a polarizing voltage coupled to conductive support member and said top conductive layer.

4. The electrostatic sonic toner release (electrostatic STORE) development apparatus of claim 1, wherein said acoustically deformable loudspeaker-like assembly includes a conductive support member comprising said first electrode member and having a relief pattern on its surface for forming air pockets against a deformable member, a deformable top conductive layer comprising said second electrode member, a deformable insulative layer separating said conductive support member from said deformable top conductive layer, and a polarizing voltage coupled to said conductive support member and said deformable top conductive layer.

5. An electrostatic sonic toner release (electrostatic STORE) development apparatus for developing latent electrostatic images in a toner image reproduction machine using charged toner particles, the (electrostatic STORE) development apparatus including:

(a) a development housing defining a sump for holding developer material containing the toner particles;

(b) developer moving means mounted within said sump for transporting developer material within said sump; and (c) a donor assembly mounted partially within said sump for receiving toner particles from said developer moving means and for transporting the toner particles through a development nip of a reproduction machine, said donor assembly including a loudspeaker-like assembly having an acoustically deformable member, first and second electrode members, a dielectric member separating said first and second electrodes, and a polarizing voltage coupled to said first and second electrode members for generating electrostatic forces to cause acoustic motions in said acoustically deformable member, thereby resulting in toner release, reduced image degrading electrostatic fields, and relatively higher quality image development.

6. The electrostatic sonic toner release (electrostatic STORE) development apparatus of claim 5, wherein said acoustically deformable member comprises a thin strong aluminized polyester film.

7. The electrostatic sonic toner release (electrostatic STORE) development apparatus of claim 5, wherein said a conductive woven screen comprises a first electrode member of said first and second electrode members.

8. The electrostatic sonic toner release (electrostatic STORE) development apparatus of claim 5, wherein said polarizing voltage comprises an A. C. voltage.

9. The electrostatic sonic toner release (electrostatic STORE) development apparatus of claim 6, wherein said a thin strong aluminized polyester film is mounted tautly over a spacing member.

10. The electrostatic sonic toner release (electrostatic STORE) development apparatus of claim 8, wherein said polarizing voltage comprises an A. C. voltage and a D. C. voltage for preventing a doubling effect of said A. C. voltage on an actual frequency of said acoustically deformable member.

11. An electrostatographic reproduction machine for creating toner images with reduced development fields, the reproduction machine comprising:

(a) a movable image bearing member supported for movement in an endless path;

(b) means for forming latent electrostatic images on said image bearing member; and (c) an electrostatic sonic toner release (electrostatic STORE) development apparatus for developing the latent electrostatic images using charged toner particles, said (electrostatic STORE) development apparatus including:

(i) a development housing defining a sump for holding developer material containing the toner particles;

(ii) developer moving means mounted within said sump for transporting developer material within said sump; and (iii) a donor assembly mounted partially within said sump for receiving toner particles from said developer moving means and for transporting the toner particles through a development nip of the reproduction machine, said donor assembly including a loudspeaker-like assembly having an acoustically deformable member, first and second electrodes, a dielectric member separating said first and second electrodes, and a polarizing voltage coupled to said first and second electrodes for generating electrostatic forces to cause acoustic motions in said acoustically deformable member, thereby resulting in toner release, reduced image degrading electrostatic fields, and relatively higher quality image development.

* * * * *